US006380502B1

(12) United States Patent
Hirschburger et al.

(10) Patent No.: US 6,380,502 B1
(45) Date of Patent: Apr. 30, 2002

(54) DETENTED SLIDE SWITCH MECHANISM

(75) Inventors: Wolfgang Hirschburger, Wilmette; Allen Oles; Edward T. Prell, both of Chicago; Edward Ennis, Niles, all of IL (US)

(73) Assignee: S-B Power Tool Company, Chicago, IL (US)

( * ) Notice: Subject to any disclaimer, the term of this patent is extended or adjusted under 35 U.S.C. 154(b) by 0 days.

(21) Appl. No.: 09/866,507

(22) Filed: May 25, 2001

(51) Int. Cl.[7] ..... H01H 15/02

(52) U.S. Cl. ..... 200/548; 200/16 D; 200/549; 200/550; 338/176; 338/178; 338/179; 338/184; 338/198; 338/200

(58) Field of Search ..... 200/16 R–16 D, 200/547–550; 338/176–179, 184, 198, 200

(56) References Cited

U.S. PATENT DOCUMENTS

| | | | | | |
|---|---|---|---|---|---|
| 2,811,593 | A | | 10/1957 | Aquillon | 200/5 |
| 4,152,565 | A | | 5/1979 | Rose | 200/291 |
| 4,698,613 | A | | 10/1987 | Okuya | 338/176 |
| 4,841,105 | A | * | 6/1989 | Goodman et al. | 200/16 D |
| 4,918,264 | A | * | 4/1990 | Yamamoto et al. | 200/5 R |
| 4,939,383 | A | | 7/1990 | Tucker et al. | 307/139 |
| 5,122,627 | A | | 6/1992 | Trana | 200/548 |
| 5,862,714 | A | * | 1/1999 | Fujimoto | 74/527 |
| 6,079,865 | A | * | 6/2000 | Plavcan et al. | 366/129 |
| 6,204,461 | B1 | * | 3/2001 | Bucher et al. | 200/330 |

* cited by examiner

*Primary Examiner*—Michael Friedhofer
(74) *Attorney, Agent, or Firm*—Greer, Burns & Crain, Ltd.

(57) ABSTRACT

A switch mechanism for an electrical slide switch that has a detenting or clicking action is disclosed. The switch mechanism provides such detenting action in a mechanism that has a switch lever that moves through an arcuate path of movement and provides a uniform resistance to movement through the entire range of movement of the switch lever.

8 Claims, 2 Drawing Sheets

DETENTED SLIDE SWITCH MECHANISM

BACKGROUND OF THE INVENTION

The present invention generally relates to electrical slide switches and more particularly to a detented slide mechanism for an electrical slide switch.

Electrical slide switches have long been used to control the operation of many devices in our everyday experience, including volume and other controls for audio and video equipment, dimmers for lights among a multitude of other products. Such slide switches have also been used for controlling the operating speed of many kinds of variable speed hand tools. One such speed control slide switch is provided in electrical powered hand tools that are used in woodworking and the like as marketed by the S-B Power Tool Company of Chicago, Ill. under the Dremel trademark. Such tools have an elongated generally cylindrical configuration with a rotating output shaft at one end to which various tools can be attached for performing tasks such as engraving, carving, polishing, cleaning, cutting, grinding, sharpening and sanding. Many of these tools have a variable speed capability which is controlled by operation of a slide switch that is located near the cord end of the tool and which is movable in a circumferential direction between an off position and a maximum speed position. The slide switch has a switch lever that generally follows the curvature of the cylindrical configuration of the housing. The switch mechanism used in the prior art Dremel tool has a smooth operating action in that it can be moved by a user relatively easily without significant resistance. While it has sufficient resistance that the switch normally does not move as a result of vibration of the tool during normal use, excessive vibration or unintended contact by the user can change the position of the switch on occasion.

The provision of a detenting mechanism in slide switches is of course generally known in the art and it also known that the manner in which such detenting action is implemented can significantly add to the complexity of the design of a slide switch.

SUMMARY OF THE INVENTION

The present invention is an improved switch mechanism for a slide switch of the type that provides a variable output resistance value as a function of the position of the switch, wherein a switch lever can be moved from a first position to a second position and to vary the resistance value of the switch, with the switch having a detented or clicking action during movement. Such detenting action enables the switch to more reliable remain at a location that is selected by the user, and also enables the user to more reliably return the switch to a desired setting. The switch mechanism embodying the present invention provides such detenting action using a mechanism that has a switch lever that travels in a curved or arcuate path when moved by a user and still provide a uniform resistance to movement detenting action through the entire range of movement of the switch lever.

DETAILED DESCRIPTION

Broadly stated, the present invention is directed to a switch mechanism for a slide switch of the type that provides a variable electrical resistance value which can be used in circuit to vary voltage or current levels as a function of the position of the switch lever. The preferred embodiment of the present invention has a detented or clicking action so that the user can easily feel movement that is being made by the switch lever during operation and also hold the switch lever in its desired location. The detenting action provides sufficient level of resistance to initial movement that the likelihood that the switch lever will move without a conscious force being applied to it is quite small. If the switch is being used in a rotating hand tool such as a Dremel tool, normal vibration experienced during operation of the tool should not affect the position of the switch lever. Also, the resistance to movement provided by the detenting action of the switch mechanism will not result in movement of the switch lever by most levels of incidental contact that is experienced during use.

Figure 1:
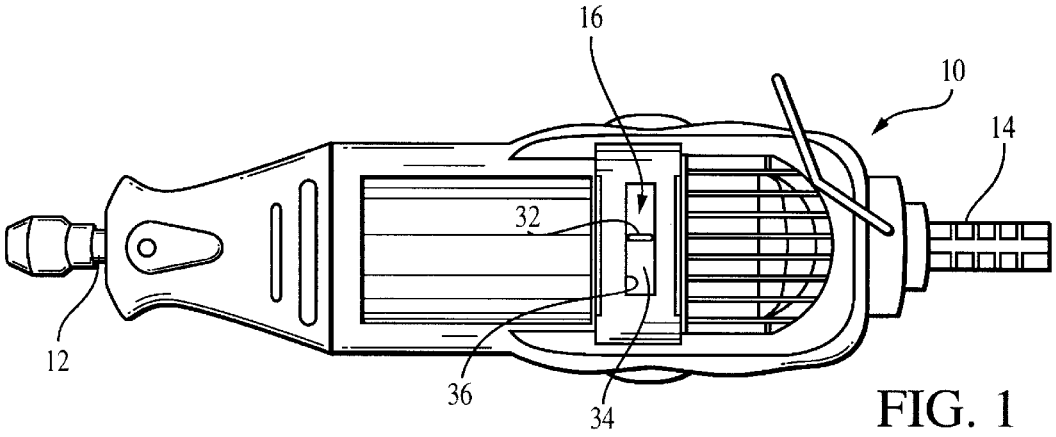
FIG. 1 is a plan view of a hand tool in which a slide switch having a switch mechanism embodying the present invention is incorporated.

Turning now to the drawings and particularly FIG. 1, a switch mechanism embodying the present invention is shown in a rotary hand tool 10 which has a generally cylindrical configuration and an output shaft 12 driven by a motor (not shown) that is powered from a power source through a cord 14. The tool includes a switch, indicated generally at 16, that is located near the cord end of the tool 12, with the switch 16 being movable in a generally circumferential direction relative to the lengthwise axis of the tool. The switch 16 is also shown in the enlarged view of FIG. 2 and comprises a housing that in the preferred embodiment comprises two sections 18 and 20 that fit together to enclose the other components of the switch 16. The housing section 18 is shown nearer the viewer in FIG. 2 and has portions removed to illustrate the components that are located inside of the housing. The housing section 20 is in view when the portions are removed from housing section 18, and housing section 20 is separately illustrated in FIG. 3. The switch mechanism embodying the present invention comprises a switch lever, indicated generally at 22, which cooperates with a carrier plate, indicated generally at 24, and a support plate indicated generally at 26. The support plate 26 has electrical circuit components mounted to it and preferably is in the form of a printed circuit board that also has one or more resistive layers applied or mounted to it that are connected in circuit so that movement of the carrier plate changes the point of contact between wiper arms attached thereto and the resistive layers of the support plate.

Figure 2:
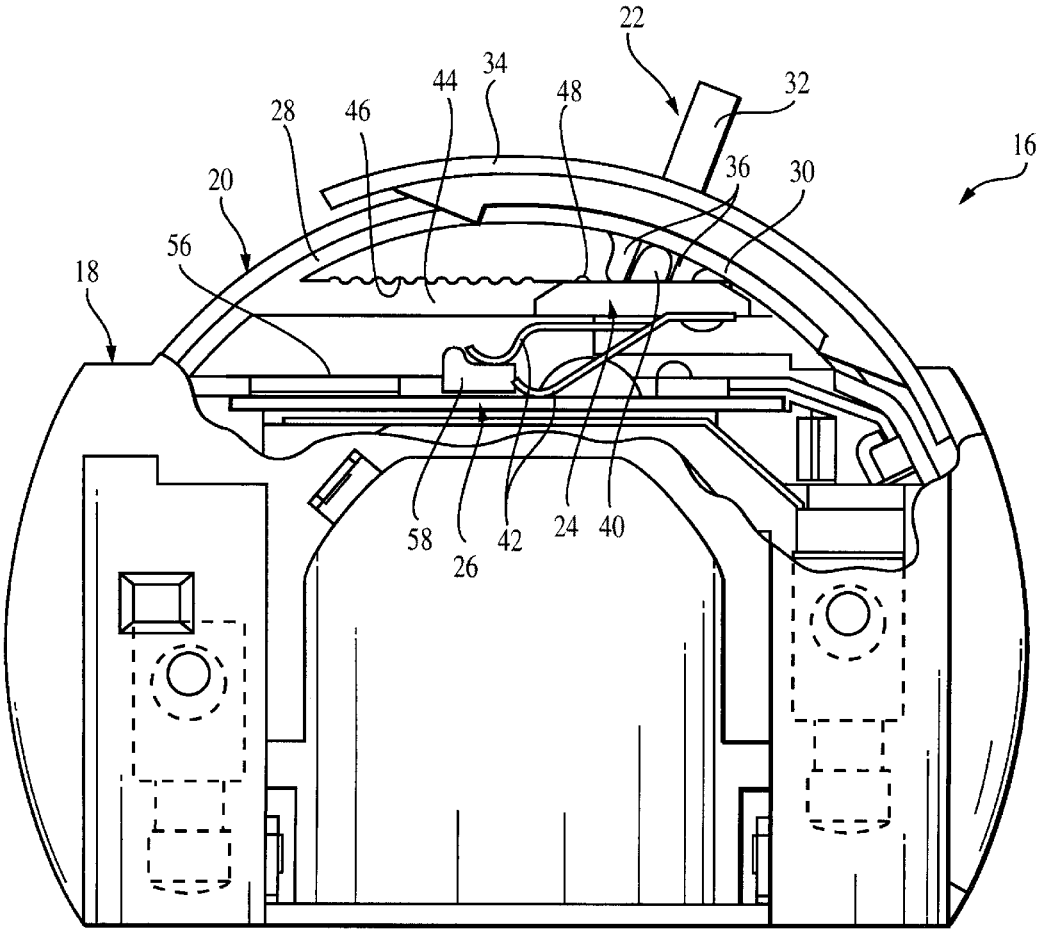
FIG. 2 is a side view of a switch that includes a switch mechanism embodying the present invention shown with portions removed to expose the operable working components of the switch mechanism.
Figure 3:
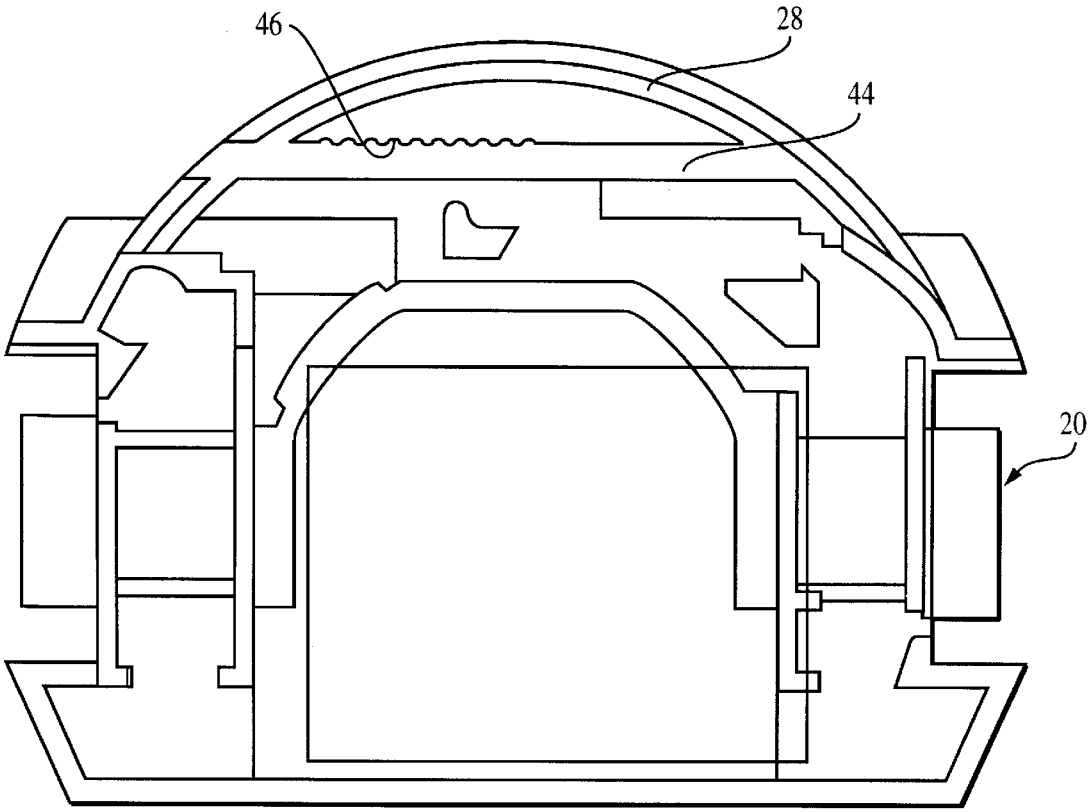
FIG. 3 is a side view of one portion of the housing of the switch shown in FIGS. 1 and 2, with the portion shown in this figure being complementary with another housing section.

A user can move the switch lever 22 along a curved path that is defined by an arcuate recess 28 in the housing 20 (see FIGS. 2 and 3). This arcuate recess is complementary to a similar recess that is not shown but located in the other housing section 18. The switch lever 22 has a lateral extension 30 on opposite sides thereof, with each extension 30 fitting in one of the arcuate recesses, which enables the switch lever 22 to move in the arcuate path as desired. A switch lever 22 has a switch handle 32 as well as an outer portion 34 that fits within an opening 36 in the tool 10 and the switch lever also has a pair of spaced apart extensions 36 on the bottom side which are adapted to engage a raised handle 40 portion of the carrier plate 24. Because the extensions 36 remain in contact with the raised handle 40 during the entire range of travel, the curved or arcuate path followed by the switch lever 22 produces horizontal movement of the carrier plate 24.

The carrier plate 24 has at least two wiper arms 42 that are biased into contact with electrical resistance strips that are applied to the support plate 26 and this biasing action, in addition to promoting good electrical contact also biases the carrier plate 24 upwardly in the view of FIG. 2. The carrier plate 24 also rides in a horizontal recess 44 that is provided in housing section 20 and a similar recess (not shown) being provided in housing section 18.

In accordance with an important aspect of the present invention, the recess 44 of the section 20 has an upper corrugated edge or surface 46 that is adapted to engage a rib 48 that is an integral part of the carrier plate 24. It should be understood that the thickness of the carrier plate 24 together with the height of the rib is preferably slightly less than the height of the recess 44 so that the carrier plate 24 can easily slide within the recesses of both housing sections 18 and 20. The rib 48 has a rounded shape that approximates the shape of the corrugations of the corrugated edge 46 so that the carrier plate can be incrementally moved along the groove. It should be understood that either a smaller or larger corrugated edge could be made compared with that shown. A larger number of smaller corrugations which would provide more detented or clicking action over the same distance as the carrier plate is moved, but would also provide less resistance to movement. It should also be understood that the amount of upward biasing force applied to the carrier plate 24 by the wiper arms 42 can be increased with stronger or less flexible wiper arms 42, and that the increased upward biasing force would increase the resistance to horizontal movement. Therefore, the combination of the biasing force provided by the wiper arms and the size of the corrugations can be chosen to accomplish the desired degree of resistance to movement of the switch mechanism. In the embodiment illustrated, the rib 48 of the carrier plate 24 has a length of approximately 2 millimeters, a height of approximately 0.4 millimeters, with the cross-section along the length being approximately semi-cylindrically shaped, and the individual detents or corrugations are approximately the same size as the top of the rib 48.

As shown in FIG. 2, the spaced extensions 36 of the switch lever 22 extend below the upper surface of the carrier plate 24 and in fact penetrate into openings in the carrier plate. As best shown in FIG. 5, openings 50 are provided on each side of the raised handle 40 and have a length that exceeds the width of the extension 36 so that there is no interference from the carrier plate to penetration of the extensions 36 that occur during movement of the switch lever 22 through its range of motion. With regard to the carrier plate 24 shown in FIGS. 4–6, it has two leg posts 52 located on the underside of the plate which are used to secure a wiper arm assembly to the plate. A flange portion 54 is also provided and it is preferably sonically welded or otherwise deflected to also secure the wiper arm assembly to the plate 24.

It should be understood that the carrier plate 24 is preferably made of plastic or plastic-like electrically insulating material, as are the switch lever 22 and the housing sections 18 and 20. Components are mounted on the support plate 26, which is preferably a basic printed circuit board on which the resistive strips are provided and a raised portion contains another resistive strip 56 that is preferably a ground connection. One of the wiper blades is shown to be resting on an extension 58 of the housing section 20 with the wiper blade being out of contact with any resistive strip. In this position, the wiper blade is not in contact with the surface 56 and therefore represents the off position for the switch.

Figure 4:
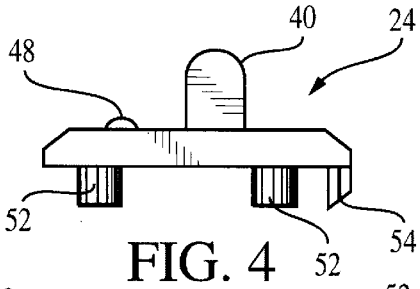
FIG. 4 is a side view of carrier plate used in the present invention, shown before it is configured to hold wiper blades as shown in FIG. 2.
Figure 5:
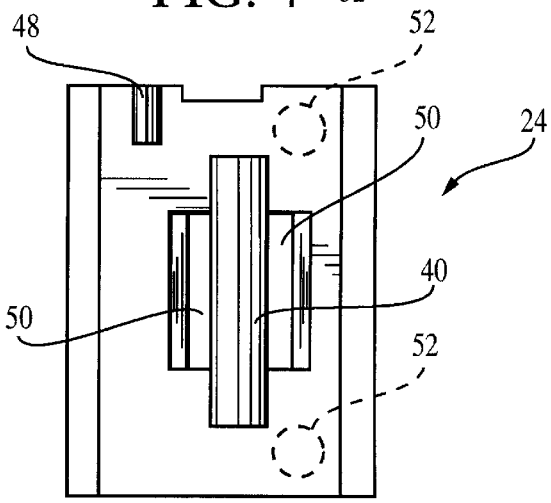
FIG. 5 is a top view of the carrier plate shown in FIG. 4.
Figure 6:
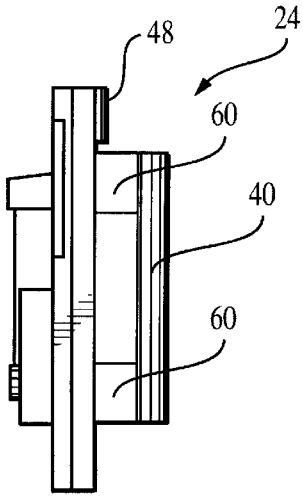
FIG. 6 is view of the carrier plate taken from the left side of FIG. 5.

Referring to FIG. 6, the raised handle 40 is generally circular in cross-section as shown in FIG. 4 in the area of the openings 50 and is supported by a support portions 60 located on each end thereof.

From the foregoing, it should be understood that a detented switch mechanism for a slide switch has been shown and described which has desirable attributes. The detenting action is achieved in a unique manner using a design that is elegant in its simplicity. The detenting action of the switch mechanism is reliable and consistent, and is achieved quite inexpensively.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A switch mechanism for a switch that provides a variable electrical resistance value when connected in circuit, with the switch mechanism being of having a switch lever that moves through an arcuate path from a first position where the electrical resistance value is at a maximum to a second position wherein the resistance value is at a minimum, the switch mechanism comprising:

a housing comprising at least two housing sections that are attached to one another, said housing having a curved outer top portion with an elongated opening through which at least a portion of a switch lever is located and movable in an arcuate path within, said housing having an internal area adjacent said outer top portion with support surfaces that are supporting support plate, said housing having a pair of spaced apart opposed slots that are generally parallel to and located above said support plate and which can receive a slideable carrier plate therein, at least one of said slots having a plurality of detents on an edge away from said support plate;

the support plate is attached to said support surfaces of said housing, said support plate having at least one elongated electrical resistance surface;

a carrier plate slideably retained in said pair of opposed slots in said housing, said carrier plate having at least one resilient wiper arm on a side nearer said support plate and an edge contact on the opposite side, said at least one wiper arm being biased into contact with said support plate, said at least one wiper arm creating a force on said carrier plate urging the corner plate away from said support plate, said edge contact being in contact with said edge having said plurality of detents;

the switch lever slideably retained in said housing and movable in the arcuate path adjacent said curved outer top portion, said lever having a lever portion extending through said elongated opening of said housing for manipulation by a user between the first and second positions, said lever contacting said carrier plate to move the corner plate responsive to user manipulation;

whereby the interaction of edge contact of said carrier plate and said edge having said detents causes incremental physical resistance to movement by a user manipulating said switch lever.

2. A switch mechanism as defined in claim 1 wherein said edge contact comprises an elongated raised rib having a contact portion that is approximately equal to the size of one of said detents.

3. A switch mechanism as defined in claim 2 wherein said rib has a length of approximately 2 millimeters, a height of approximately 0.4 millimeters, with the cross-section along the length being approximately semi-cylindrically shaped.

4. A switch mechanism as defined in claim 3 wherein said plurality of detents merge with one another along said edge and approximate a corrugated shape.

5. A switch mechanism for a switch that provides a variable electrical resistance value and has a switch lever that moves through an arcuate path from a first position where the electrical resistance value is at a maximum to a second position wherein the resistance value is at a minimum, the switch mechanism comprising:

a housing comprising at least two housing sections that are attached to one another, said housing having a curved outer top portion with an elongated opening through which at least a portion of the switch lever is located and movable in the arcuate path within, said housing having a space adjacent said outer top portion with support surfaces that are supporting a support plate, said housing having a pair of spaced apart opposed recessed slots, each of the slots have an upper horizontal wall, a lower horizontal wall and vertical wall, said slots being generally parallel to and located above said support plate and receiving a slideable carrier plate therein, at least one of said slots having a detented surface on at least a portion of the upper horizontal wall thereof;

the support plate attached to said support surfaces of said housing, said support plate having at least one elongated electrical resistance surface;

the carrier plate slideably retained in said pair of opposed slots in said housing, said carrier plate having at least one resilient wiper arm attached to and extending downwardly from a bottom thereof and an elongated rib extending upwardly from a top side thereof adjacent at least one of said slots, at least one wiper arm being biased into contact with said support plate and urging said carrier plate upwardly in said slots so that said rib is in contact with said detented surface;

the switch lever slideably retained in said housing and movable in the arcuate path adjacent said curved outer top portion, said lever having a lever portion extending through said elongated opening of said housing for manipulation by a user between the first and second positions, said lever contacting said carrier plate to move the corner plate responsive to user manipulation;

whereby the interaction of said rib and said detented surface causes incremental physical resistance to movement by a user manipulating said switch lever.

6. A switch mechanism as defined in claim 5 wherein said rib has a length of approximately 2 millimeters, a height of approximately 0.4 millimeters, with the cross-section along the length being approximately semi-cylindrically shaped.

7. A switch mechanism as defined in claim 5 wherein said detented surface comprises a plurality of corrugations extending along said top side of said at least one slot.

8. A switch mechanism as defined in claim 7 wherein said corrugations comprises alternating ridges and grooves that merge with one another.

* * * * *

UNITED STATES PATENT AND TRADEMARK OFFICE

CERTIFICATE OF CORRECTION

PATENT NO. : 6,380,502 B1
DATED : April 30, 2002
INVENTOR(S) : Hirschburger et al.

It is certified that error appears in the above-identified patent and that said Letters Patent is hereby corrected as shown below:

Column 4,
Line 62, delete “corner” and insert -- carrier --.

Column 5,
Line 4, delete “corner” and insert -- carrier --.

Column 6,
Line 12, before “at”, second occurrence, insert -- said --.
Line 22, delete “corner” and insert -- carrier --.

Signed and Sealed this

Fourth Day of February, 2003

JAMES E. ROGAN
*Director of the United States Patent and Trademark Office*